US010204717B2

(12) United States Patent
Tsujino et al.

(10) Patent No.: US 10,204,717 B2
(45) Date of Patent: Feb. 12, 2019

(54) PARALLEL PAIR CABLE

(71) Applicant: SUMITOMO ELECTRIC INDUSTRIES, LTD., Osaka-shi, Osaka (JP)

(72) Inventors: Atsushi Tsujino, Kanuma (JP); Yuto Kobayashi, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/723,313

(22) Filed: Oct. 3, 2017

(65) Prior Publication Data

US 2018/0096755 A1 Apr. 5, 2018

(30) Foreign Application Priority Data

Oct. 5, 2016 (JP) ..... 2016-197535

(51) Int. Cl.

| | |
|---|---|
| ***H01B 11/00*** | (2006.01) |
| ***H01B 7/22*** | (2006.01) |
| ***H01B 7/30*** | (2006.01) |
| ***H01B 7/02*** | (2006.01) |
| ***H01B 11/18*** | (2006.01) |
| *H01B 11/20* | (2006.01) |

(52) U.S. Cl.

CPC ..... *H01B 11/002* (2013.01); *H01B 7/0241* (2013.01); *H01B 7/221* (2013.01); *H01B 7/30* (2013.01); *H01B 11/1826* (2013.01); *H01B 11/203* (2013.01)

(58) Field of Classification Search

CPC ..... H01B 11/08; H01B 11/085; H01B 11/002; H01B 7/0241; H01B 7/221; H01B 7/30; H01B 13/2613

See application file for complete search history.

(56) References Cited

U.S. PATENT DOCUMENTS

| | | | | |
|---|---|---|---|---|
| 7,790,981 | B2 | 9/2010 | Vaupotic et al. | |
| 2004/0026101 | A1* | 2/2004 | Ochi | H01B 7/0861 174/36 |
| 2006/0054334 | A1* | 3/2006 | Vaupotic | H01B 11/1008 174/36 |

FOREIGN PATENT DOCUMENTS

| | | | |
|---|---|---|---|
| JP | 2002-319319 | A | 10/2002 |

* cited by examiner

*Primary Examiner* — Hoa C Nguyen
*Assistant Examiner* — Amol H Patel
(74) *Attorney, Agent, or Firm* — Drinker Biddle & Reath LLP

(57) ABSTRACT

A parallel pair cable includes a pair of insulated electric wires aligned in parallel, a shield tape longitudinally wrapped around the pair of insulated electric wires, a drain wire disposed inside the shield tape, and an insulating tape wrapped on an outer side of the shield tape. The shield tape has a metal layer provided on an inner surface thereof. The drain wire is provided to electrically contact the metal layer. A surface of the metal layer is provided with an adhesion surface having an adhesive applied thereto. The adhesion surface and the pair of insulated electric wires are adhered to each other. An area of the adhesion surface is 30% to 70% of a surface area of the metal layer.

2 Claims, 4 Drawing Sheets

PARALLEL PAIR CABLE

CROSS-REFERENCE TO RELATED APPLICATION

The present application claims priority from Japanese Patent Application No. 2016-197535 filed on Oct. 5, 2016, the entire content of which is incorporated herein by reference.

BACKGROUND

Technical Field

The present invention relates to a parallel pair cable.

Related Art

A parallel pair cable, which includes a conductive shield tape wrapped around a pair of insulated electric wires aligned in parallel and an insulating tape wrapped on an outer side of the shield tape, has been known (for example, refer to Patent Documents 1 and 2)

Patent Document 1: JP-A-2002-319319

Patent Document 2: U.S. Pat. No. 7,790,981

SUMMARY

Exemplary embodiments of the invention provide a parallel pair cable capable of reducing an output amount (Scd21) of a common mode relative to an input signal of a differential mode upon transmission of a differential signal.

A parallel pair cable according to an exemplary embodiment, comprises:

a pair of insulated electric wires aligned in parallel;

a shield tape longitudinally wrapped around the pair of insulated electric wires;

a drain wire disposed inside the shield tape; and an insulating tape wrapped on an outer side of the shield tape, wherein the shield tape has a metal layer provided on an inner surface thereof, wherein the drain wire is provided to electrically contact the metal layer, wherein a surface of the metal layer is provided with an adhesion surface having an adhesive applied thereto, wherein the adhesion surface and the pair of insulated electric wires are adhered to each other, and wherein an area of the adhesion surface is 30% to 70% of a surface area of the metal layer.

A parallel pair cable according to an exemplary embodiment, comprises:

a pair of insulated electric wires aligned in parallel;

a shield tape longitudinally wrapped around the pair of insulated electric wires;

a drain wire disposed inside the shield tape; and an insulating tape wrapped on an outer side of the shield tape, wherein the shield tape has a metal layer provided on an inner surface thereof, wherein the drain wire is provided to electrically contact the metal layer, wherein an outer surface of the shield tape is provided with an adhesion surface having an adhesive applied thereto, wherein the adhesion surface and the insulating tape are adhered to each other, and wherein an area of the adhesion surface is 30% or greater of an outer surface area of the shield tape.

An inner surface of the shield tape is not applied with an adhesive.

A parallel pair cable according to an exemplary embodiment, comprises:

a pair of insulated electric wires aligned in parallel;

a shield tape longitudinally wrapped around the pair of insulated electric wires;

a drain wire disposed outside the shield tape; and an insulating tape wrapped on an outer side of the shield tape, wherein the shield tape has a metal layer provided on an outer surface thereof, wherein the drain wire is provided to electrically contact the metal layer, wherein an inner surface of the shield tape is provided with an adhesion surface having an adhesive applied thereto, wherein the adhesion surface and the pair of insulated electric wires are adhered to each other, and wherein an area of the adhesion surface is 30% or greater of an inner surface area of the shield tape.

A parallel pair cable according to an exemplary embodiment, comprises:

a pair of insulated electric wires aligned in parallel;

a shield tape longitudinally wrapped around the pair of insulated electric wires;

a drain wire disposed outside the shield tape; and an insulating tape wrapped on an outer side of the shield tape, wherein the shield tape has a metal layer provided on an outer surface thereof, wherein the drain wire is provided to electrically contact the metal layer, wherein a surface of the metal layer is provided with an adhesion surface having an adhesive applied thereto, wherein the adhesion surface and the insulating tape are adhered to each other, and wherein an area of the adhesion surface is 30% to 70% of a surface area of the metal layer.

According to the exemplary embodiment, it is possible to reduce an output amount (Scd21) of a common mode relative to an input signal of a differential mode upon transmission of a differential signal.

DETAILED DESCRIPTION

Figure 1:
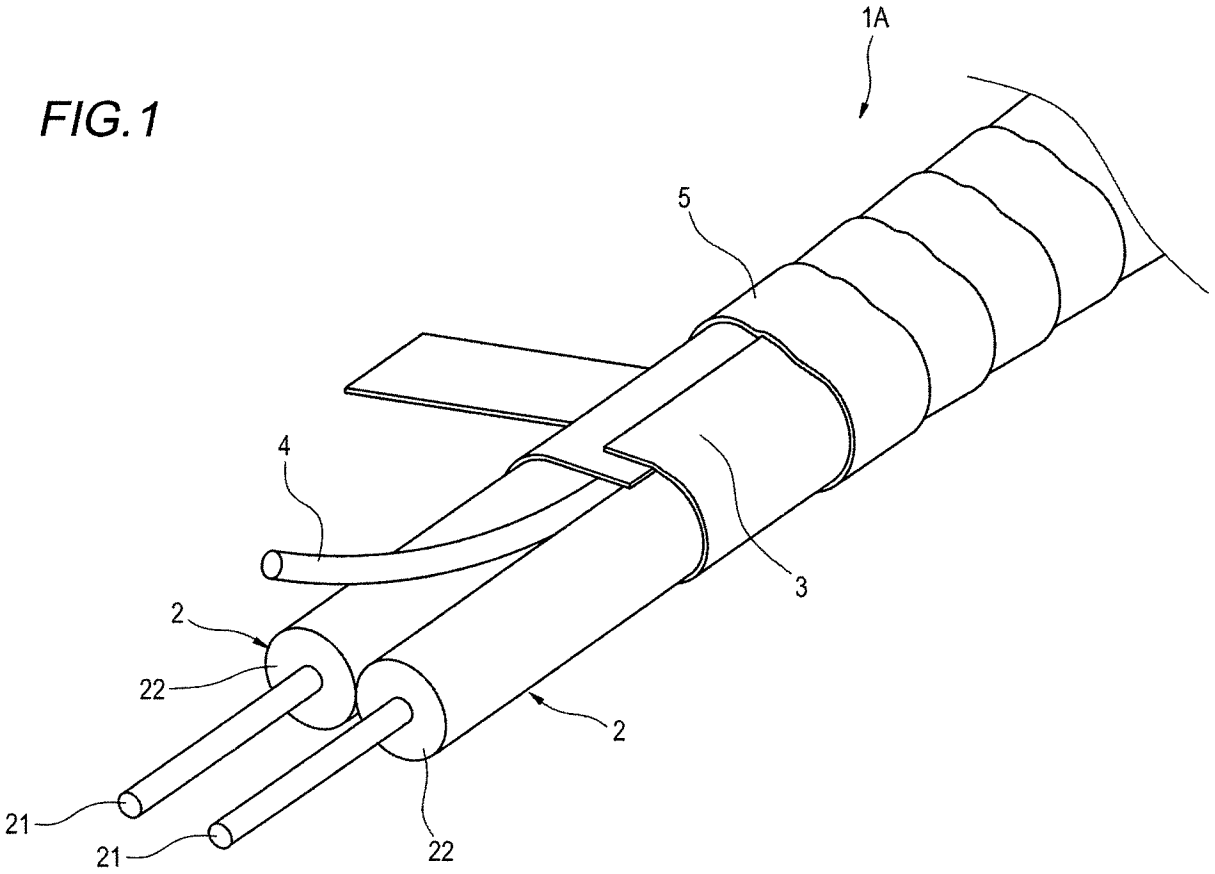
FIG. 1 is a perspective view depicting a configuration of a parallel pair cable according to a first exemplary embodiment of the present invention.

Description of Exemplary Embodiments of Present Invention

First, exemplary embodiments of the present invention are described in conformity to the claims.

(1) A parallel pair cable according to an exemplary embodiment, comprises:

a pair of insulated electric wires aligned in parallel;

a shield tape longitudinally wrapped around the pair of insulated electric wires;

a drain wire disposed inside the shield tape; and an insulating tape wrapped on an outer side of the shield tape, wherein the shield tape has a metal layer provided on an inner surface thereof, wherein the drain wire is provided to electrically contact the metal layer, wherein a surface of the metal layer is provided with an adhesion surface having an adhesive applied thereto, wherein the adhesion surface and the pair of insulated electric wires are adhered to each other, and wherein an area of the adhesion surface is 30% to 70% of a surface area of the metal layer.

When transmitting a differential signal through the parallel pair cable, when a signal wire (an insulated electric wire or the like) shifts relatively to the conductive shield tape, a shield effect for the signal wire becomes unstable, so that an output amount (Scd21) of a common mode relative to an input signal of a differential mode may increase.

According to the above configuration, since the area of the adhesion surface is equal to or less than 70%, it is possible to secure an electrical conduction between the drain wire inside the shield tape and the metal layer of the shield tape. Also, since the area of the adhesion surface is equal to or greater than 30%, it is possible to securely adhere the insulated electric wires and the shield tape. Thereby, since it is possible to fix the shield tape so as not to shift relatively to the pair of insulated electric wires, the shield effect for the insulated electric wires (signal wire) becomes stable, so that it is possible to reduce an output amount (Scd21) of a common mode relative to the input signal of a differential mode.

(2) The adhesive applied to the adhesion surface of the metal layer is a conductive adhesive, and the metal layer and the drain wire are adhered to each other by the conductive adhesive.

According to the above configuration, it is possible to more securely ensure the electrical conduction between the drain wire and the metal layer of the shield tape.

(3) A parallel pair cable according to an exemplary embodiment, comprises:

a pair of insulated electric wires aligned in parallel;

a shield tape longitudinally wrapped around the pair of insulated electric wires;

a drain wire disposed inside the shield tape; and an insulating tape wrapped on an outer side of the shield tape, wherein the shield tape has a metal layer provided on an inner surface thereof, wherein the drain wire is provided to electrically contact the metal layer, wherein an outer surface of the shield tape is provided with an adhesion surface having an adhesive applied thereto, wherein the adhesion surface and the insulating tape are adhered to each other, and wherein an area of the adhesion surface is 30% or greater of an outer surface area of the shield tape.

According to the above configuration, it is possible to securely ensure the electrical conduction between the drain wire inside the shield tape and the metal layer of the shield tape. Also, since the shield tape is adhered to the insulating tape wrapped on the outer side thereof, the shield tape is fixed to the insulating tape. The insulating tape holds the shield tape. Thereby, it is possible to prevent the shield tape from deviating relative to the pair of insulated electric wires. Since the shield tape hardly deviates relative to the pair of insulated electric wires, the shield effect for the insulated electric wires (signal wire) becomes stable, so that it is possible to reduce the output amount (Scd21) of the common mode relative to the input signal of the differential mode.

(4) A parallel pair cable according to an exemplary embodiment, comprises:

a pair of insulated electric wires aligned in parallel;

a shield tape longitudinally wrapped around the pair of insulated electric wires;

a drain wire disposed outside the shield tape; and an insulating tape wrapped on an outer side of the shield tape, wherein the shield tape has a metal layer provided on an outer surface thereof, wherein the drain wire is provided to electrically contact the metal layer, wherein an inner surface of the shield tape is provided with an adhesion surface having an adhesive applied thereto, wherein the adhesion surface and the pair of insulated electric wires are adhered to each other, and wherein an area of the adhesion surface is 30% or greater of an inner surface area of the shield tape.

According to the above configuration, it is possible to ensure the electrical conduction between the drain wire and the metal layer of the shield tape. Also, since the area of the adhesion surface, which is the inner surface of the shield tape applied with the adhesive, is equal to or greater than 30%, it is possible to securely adhere the insulated electric wires and the shield tape. Thereby, since it is possible to fix the shield tape so as not to deviate relative to the pair of insulated electric wires, the shield effect for the insulated electric wires (signal wire) becomes stable, so that it is possible to reduce the output amount (Scd21) of the common mode relative to the input signal of the differential mode.

(5) A parallel pair cable according to an exemplary embodiment, comprises:

a pair of insulated electric wires aligned in parallel;

a shield tape longitudinally wrapped around the pair of insulated electric wires;

a drain wire disposed outside the shield tape; and an insulating tape wrapped on an outer side of the shield tape, wherein the shield tape has a metal layer provided on an outer surface thereof, wherein the drain wire is provided to electrically contact the metal layer, wherein a surface of the metal layer is provided with an adhesion surface having an adhesive applied thereto, wherein the adhesion surface and the insulating tape are adhered to each other, and wherein an area of the adhesion surface is 30% to 70% of a surface area of the metal layer.

Since the area of the adhesion surface, which is the outer surface of the shield tape applied with the adhesive, is equal to or less than 70%, it is possible to ensure the electrical conduction between the drain wire outside the shield tape and the metal layer of the shield tape. Also, since the area of the adhesion surface is equal to or greater than 30%, the shield tape is adhered and fixed to the insulating tape wrapped on the outer side of the shield tape. Thereby, the shield tape hardly deviates relative to the pair of insulated electric wires.

(Details of Exemplary Embodiments of Present Invention)

Hereinafter, specific examples of the parallel pair cable according to exemplary embodiments of the present invention will be described with reference to the drawings.

In the meantime, the present invention is not limited to the examples, is defined in the claims and includes all changes within meanings and ranges equivalent to the claims.

First Exemplary Embodiment

Figure 2:
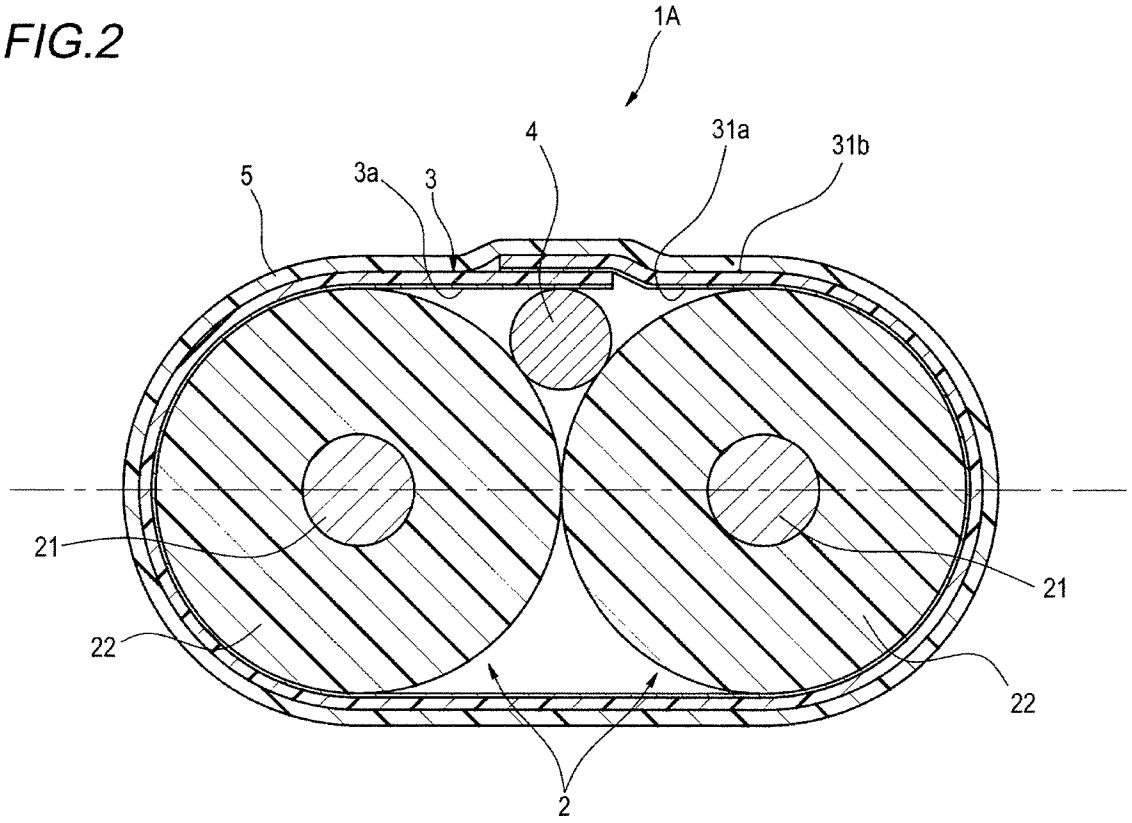
FIG. 2 is a sectional view perpendicular to a longitudinal direction of the parallel pair cable of FIG. 1.

As shown in FIGS. 1 and 2, a parallel pair cable 1A includes a pair of insulated electric wires 2 aligned in parallel with being in contact with each other, and a shield tape 3 wrapped around the pair of insulated electric wires 2. In addition, the parallel pair cable 1A includes a drain wire 4 disposed inside the shield tape 3 along the insulated electric wires 2 and an insulating tape 5 wrapped on an outer side of the shield tape 3.

The insulated electric wire 2 has a signal conductor 21 provided at a central portion thereof and an insulator 22 configured to cover the signal conductor 21. The signal conductor 21 is a single wire or a twisted wire formed of a conductor such as copper, aluminum or the like or a conductor plated with tin, silver or the like. A size of the conductor used for the signal conductor 21 is AWG38 to AWG22 on the basis of AWG (American Wire Gauge) standards. The insulator 22 is formed of polyethylene (PE), ethylene vinyl acetate copolymer (EVA), fluorine resin or the like. The insulator may be a solid layer. Alternatively, the insulator may be a foamed layer. In the case that the insulator is a foamed layer, a residual diameter ratio (a value obtained by dividing a diameter of the insulated electric wire in a crushing direction after deformation by a diameter of the insulated electric wire before deformation when an external force is applied to the insulator) of the insulated electric wire when load of 1 kg is applied for 30 minutes is preferably 80% to 99%. An outer diameter of the insulated electric wire 2 is about 0.3 mm to 3.0 mm, for example, and is about 0.9 mm when the signal conductor 21 of AWG30 is used, for example.

In the first exemplary embodiment, the two insulated electric wires 2 are aligned in parallel. However, instead of the two insulated electric wires 2 aligned in parallel, for example, the two signal conductors 21 which are extruded and coated using a thermoplastic resin such as polyethylene, polyvinyl chloride, fluorine resin or the like and then formed into a glasses type, an elliptical shape or the like may be used.

The shield tape 3 is formed of a resin tape having a metal layer in which a metal layer 3*a* such as copper, aluminum or the like is adhered or vapor-deposited to a resin tape such as polyethylene terephthalate (PET), polyvinyl chloride (PVC) or the like. A thickness of the shield tape 3 is about 10 μm to 50 μm, for example, and a thickness of the metal layer 3*a* is about 0.1 μm to 20 μm, for example. In the meantime, for the shield tape 3, a metal tape of which both surfaces are formed of metal or a resin tape having a metal layer in which metal tapes are adhered to both surfaces of a resin tape may be used, for example. The shield tape 3 is longitudinally wrapped around the insulated electric wires 2 and the drain wire 4. An edge of the shield tape 3 is parallel to the longitudinal direction of the cable 1A. The longitudinally wrapped shield tape 3 is preferably applied with an adhesive at overlapping portions thereof. The overlapping portions are fixed by the adhesive, so that the wrapped shape is kept. Also, the shield tape 3 is wrapped so that the metal layer 3*a* is disposed on an inner side thereof, i.e., the metal layer 3*a* faces toward the insulated electric wires 2 and the drain wire 4.

An inner surface of the shield tape 3, i.e., a surface on which the metal layer 3*a* is provided is applied with an epoxy-based or silicone-based insulating adhesive 31*a*, for example. Also, an outer surface of the shield tape 3, i.e., a surface on which the metal layer 3*a* is not provided has no adhesive.

The adhesive 31*a* to be applied on the inner surface of the shield tape 3 is applied to a surface of the metal layer 3*a* so that an area of a part (hereinafter, referred to as 'adhesion surface') to which the adhesive is applied is 30% to 70% of an area of one surface (metal layer 3*a*) of the shield tape. The adhesive 31*a* is applied as less as possible to a place at which the metal layer 3*a* and the drain wire 4 contact each other so that the metal layer 3*a* and the drain wire 4 are electrically connected. For example, the adhesive 31*a* is applied in a zebra shape, a grid shape, a dotted shape or the like. Alternatively, the adhesive 31*a* may not be applied to the place at which the metal layer 3*a* and the drain wire 4 contact each other, and may be thoroughly applied to the surface of the metal layer 3*a* at a place at which the metal layer 3*a* and the drain wire 4 do not contact each other. A thickness of the adhesive 31*a* is about 2 μm to 10 μm, for example.

In the meantime, the adhesive 31*a* to be applied may be conductive. In this case, the adhesive may be applied to one entire surface (metal layer 3*a*) of the shield tape. When the metal layers are provided on both surfaces of the shield tape, the adhesive 31*a* to be applied to the outer metal layer may be as described above, or the adhesive may not be applied to the outer metal layer.

An adhesive 31*b* may be applied to an outer surface of the shield tape 3. For example, the adhesive 31*b* may be applied to the entire outer surface of the shield tape 3. A thickness of the adhesive 31*b* is about 0.1 μm to 5 μm, for example.

When the shield tape 3 is applied with the adhesive 31*b*, the overlapping portions of the shield tape 3 are adhered. The shield tape 3 and the insulating tape 5 are also adhered.

The drain wire 4 is a conductor wire of copper, aluminum or the like. The drain wire 4 is longitudinally attached to a recess at which the pair of insulated electric wires 2 aligned in parallel is in contact with each other so that the drain wire contacts both the insulated electric wires 2. The longitudinally attached drain wire 4 is provided to electrically contact the metal layer 3*a* disposed on the inner side of the shield tape 3. An outer diameter of the drain wire 4 is about 0.08 mm to 0.8 mm, for example.

In the meantime, when the two signal conductors 21 are extruded and coated using a thermoplastic resin, instead of the configuration where the two insulated electric wires 2 are aligned in parallel, the drain wire 4 is preferably longitudinally attached to a position at which it is well symmetric with respect to the two signal conductors 21. Also in this case, the drain wire 4 is electrically contacted to the metal layer 3*a* disposed on the inner side of the shield tape 3.

The insulating tape 5 is formed of a resin tape such as PET, PVC or the like, and is spirally wrapped (helically wrapped) on the outer side of the shield tape 3, for example. The insulating tape 5 may be one layer (but becomes two layers at overlapping portions thereof). A thickness of the insulating tape 5 is 12 μm or greater and 50 μm or less, preferably 15 μm or greater, more preferably 18 μm or greater, and most preferably 24 μm or greater, for example. In the meantime, the insulating tape 5 may also be wrapped in a two-layered shape. An adhesive is applied to an inner surface of the insulating tape 5. In the meantime, a metal layer may be adhered or vapor-deposited to the insulating tape 5.

The insulating tape 5 is provided around the shield tape 3, so that the mechanical strength of the cable 1A is increased and the contamination from an outside can be prevented.

According to the parallel pair cable 1A configured as described above, an area of the adhesion surface of the adhesive 31*a*, which is applied to the metal layer 3*a* provided on the inner surface of the shield tape 3, is 30% or greater of a surface area of the metal layer 3*a*. For this reason, it is possible to securely adhere the shield tape 3 to the pair of insulated electric wires 2, and to fix the shield tape 3 so as not to shift relatively to the insulated electric wires 2. Also, since the area of the adhesion surface of the adhesive 31*a* is 70% or less of the surface area of the metal layer 3*a*, it is possible to sufficiently secure the electrical conduction between the metal layer 3*a* of the shield tape 3 and the drain wire 4. Furthermore, since the adhesive 31*a* is applied to the surface of the metal layer 3*a* in a zebra shape or the like, for example, it is possible to securely electrically connect the metal layer 3*a* of the shield tape 3 and the drain wire 4.

When the adhesive 31*b* is applied to the outer surface of the shield tape 3, the shield tape 3 is securely adhered and fixed to the insulating tape 5 spirally wrapped to the outer side of the shield tape. The insulating tape 5 is spirally wrapped to hold the shield tape. Thereby, the shield tape 3 and the pair of insulated electric wires 2 are fixed.

Since the shield tape 3 is longitudinally wrapped around the pair of insulated electric wires 2, it is possible to increase the electrical characteristics (when a high-frequency signal is transmitted, an attenuation of the signal is not abruptly increased at a specific wavelength), as compared to a case where it is spirally wrapped.

The thickness of the insulating tape 5 wrapped to the outer side of the shield tape 3 is preferably made to be large (for example, 12 μm or greater). Thereby, it is possible to further prevent the shield tape 3 from deviating relative to the insulated electric wires 2.

The insulating tape 5 is spirally wrapped, so that the shield tape 3 is pressed from the outer side thereof and the metal layer 3*a* of the shield tape 3 and the drain wire 4 are thus electrically contacted further securely.

When the drain wire 4 is arranged at a recess between the pair of insulated electric wires 2 with being contacted to both the insulated electric wires 2, each insulated electric wire 2 is equally crushed by the pressing from the drain wire 4, so that a difference between dielectric constants of the insulated electric wires hardly occurs. Thereby, when a differential signal is transmitted, the signal is hardly deteriorated.

As above described, the shield effect for the insulated electric wires (signal wire) 2 by the shield tape 3 becomes stable, so that it is possible to reduce the output amount (Scd21) of the common mode relative to the input signal of the differential mode.

Modified Embodiment of First Exemplary Embodiment

A modified embodiment of the first exemplary embodiment is different from the first exemplary embodiment, in terms of the configuration of the adhesive application to the shield tape 3. In the meantime, the other configurations are the same as the first exemplary embodiment, and the similar descriptions are omitted. A schematic outline of the modified embodiment is similar to the parallel pair cable 1A shown in FIGS. 1 and 2.

In the modified embodiment, the inner surface of the shield tape 3 is not applied with the adhesive. This is different from the first exemplary embodiment.

The outer surface of the shield tape 3 is applied with the adhesive 31*b* so that the area of the adhesion surface is 30% or greater of the entire surface area of the outer surface. For example, the adhesive 31*b* may be applied to the entire outer surface of the shield tape 3. The thickness of the adhesive 31*b* is about 2 μm, for example.

According to the above configuration of the modified embodiment, since the inner surface of the shield tape 3 is not applied with the adhesive, the metal layer 3*a* and the drain wire 4 are directly contacted to each other, so that it is possible to securely ensure the electrical conduction between the drain wire 4 and the metal layer 3*a* of the shield tape 3.

Since the shield tape 3 is adhered to the insulating tape 5 wrapped to the outer side thereof, the shield tape is fixed to the insulating tape 5. The insulating tape 5 is spirally wrapped to hold the shield tape 3. At this state, the shield tape and the insulating tape are adhered and fixed. Thereby, it is possible to prevent the shield tape 3 from deviating relative to the insulated electric wires 2.

Therefore, the shield effect for the insulated electric wires (signal wire) 2 by the shield tape 3 becomes stable, so that it is possible to reduce the output amount (Scd21) of the common mode relative to the input signal of the differential mode.

Second Exemplary Embodiment

Figure 3:
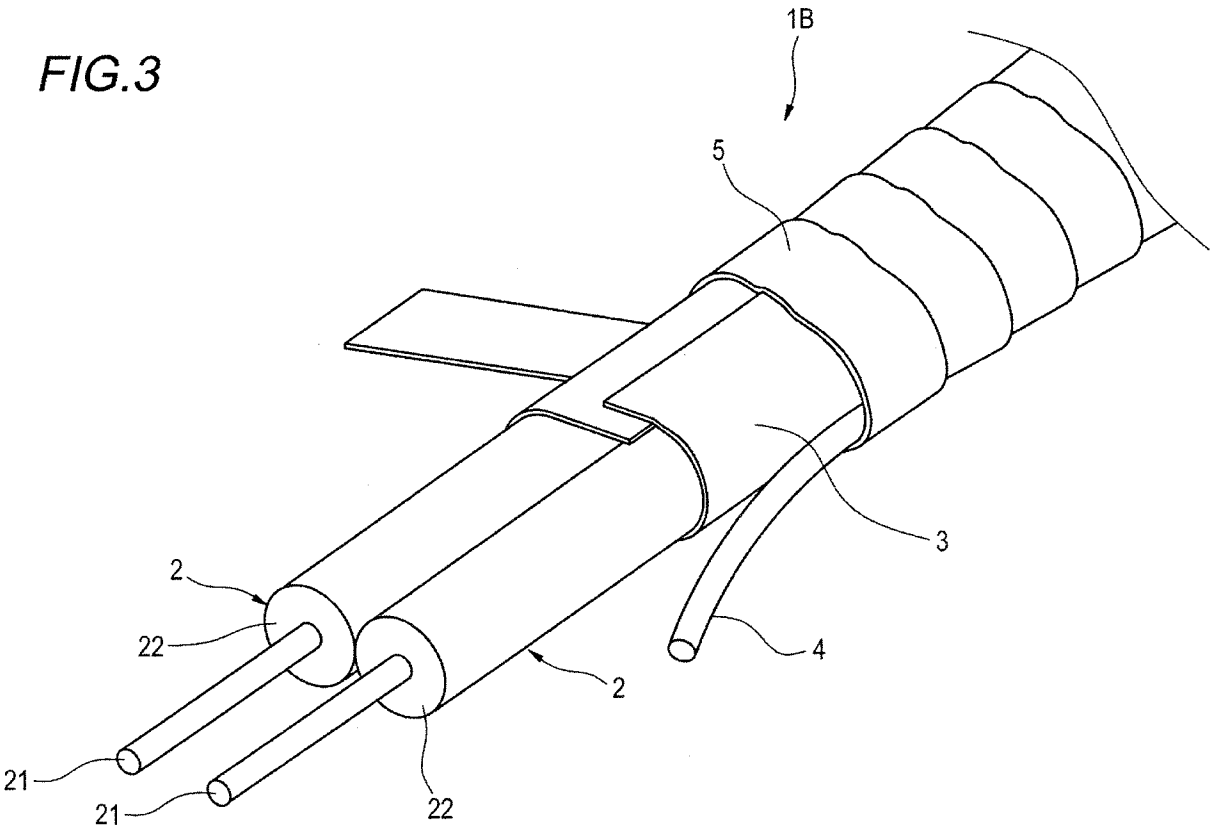
FIG. 3 is a perspective view depicting a configuration of a parallel pair cable according to a second exemplary embodiment of the present invention.
Figure 4:
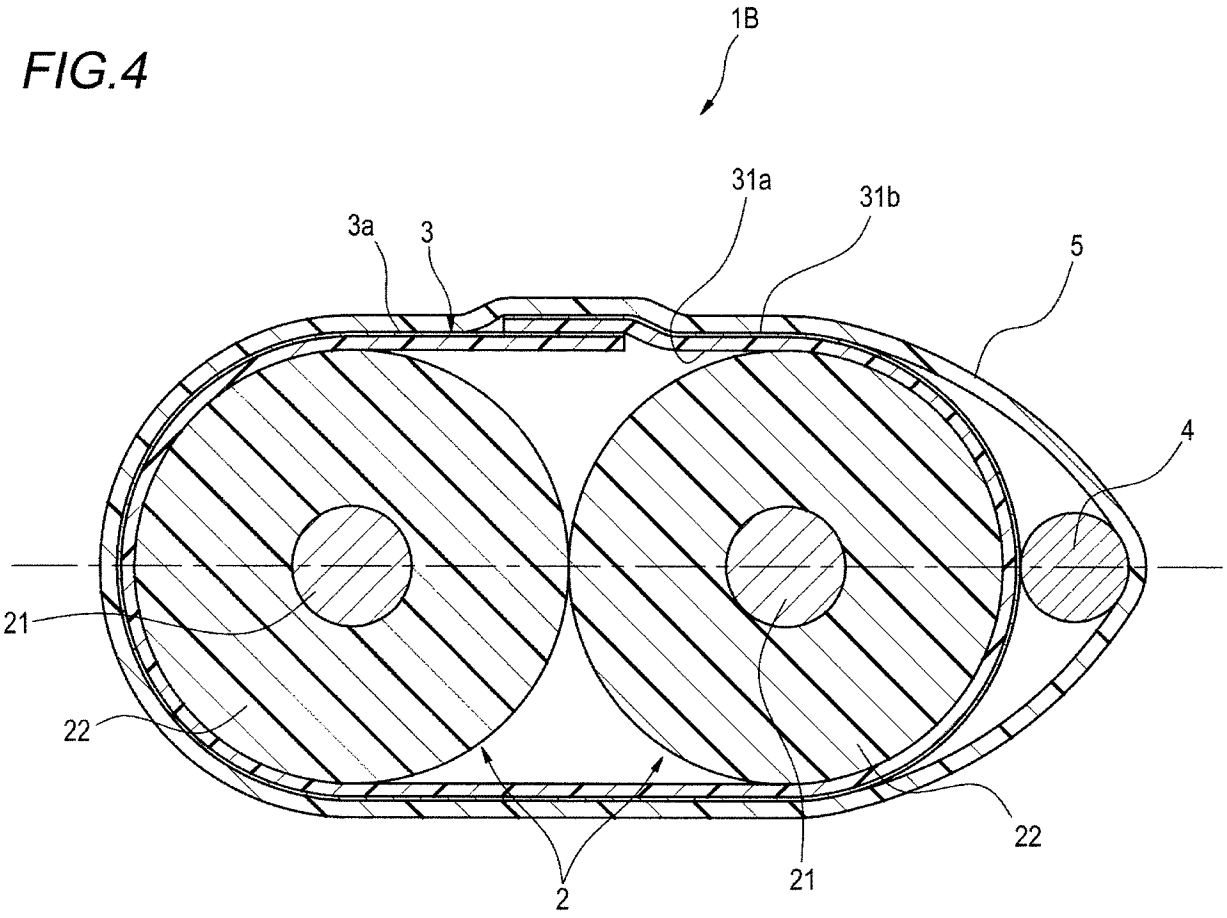
FIG. 4 is a sectional view perpendicular to a longitudinal direction of the parallel pair cable of FIG. 3.

As shown in FIGS. 3 and 4, a parallel pair cable 1B includes a pair of insulated electric wires 2 aligned in parallel with being in contact with each other, and a shield tape 3 wrapped around the pair of insulated electric wires 2. Also, the parallel pair cable 1B includes a drain wire 4 disposed outside the shield tape 3 along the insulated electric wires 2 and an insulating tape 5 wrapped on outer sides of the shield tape 3 and the drain wire 4. In the meantime, since the parts denoted with the same reference numerals as the first exemplary embodiment have the same functions, the similar descriptions thereof are omitted.

The shield tape 3 is longitudinally wrapped around the pair of insulated electric wires 2. The shield tape 3 is wrapped so that a metal layer 3*a* is disposed on the outer side, i.e., the metal layer 3*a* is not contacted to the insulated electric wires 2.

An inner surface of the shield tape 3, i.e., a surface on which the metal layer 3*a* is not provided is applied with an insulating adhesive 31*a*. Also, the outer surface of the shield tape 3, i.e., the surface on which the metal layer 3*a* is provided is applied with an insulating adhesive 31*b*. In the meantime, the outer surface on which the metal layer 3*a* is provided may not be applied with the adhesive 31*b*.

The adhesive 31*a* is applied to the inner surface of the shield tape 3 so that an area of the adhesion surface is 30% or greater of a total surface area of the inner surface. For example, the adhesive 31*a* may be thoroughly applied to the inner surface of the shield tape 3. A thickness of the adhesive 31*a* is about 0.1 μm to 5 μm, for example. When both surfaces of the shield tape are provided with the metal layers, the adhesive 31*a* to be applied to the inner metal layer is as described above.

The adhesive 31*b* is applied to the outer surface on which the metal layer 3*a* is provided, as follows.

The adhesive 31*b* to be applied to the outer surface of the shield tape 3 is applied to the surface of the metal layer 3*a* so that the area of the adhesion surface is 30% to 70% of a total area of the metal layer 3*a*. The adhesive 31*b* is applied in a zebra shape, a grid shape, a dotted shape or the like, for example. A thickness of the adhesive 31*b* is about 2 μm, for example. In the meantime, the adhesive 31*b* to be applied may be conductive. In this case, the adhesive 31*b* may be thoroughly applied to the surface of the metal layer 3*a*. Also, the adhesive 31*b* may be thoroughly applied to a part except for the part the metal layer 3*a* of the shield tape 3 in contact with the drain wire 4.

The drain wire 4 is longitudinally attached to a lateral side of one insulated electric wire 2 of the pair of insulated electric wires 2 aligned in parallel with the shield tape 3 being interposed therebetween, i.e., without being directly contacted to insulated electric wire 2. The longitudinally attached drain wire 4 is provided to electrically contact the metal layer 3*a* disposed on the outer side of the shield tape 3. In the meantime, the position at which the drain wire 4 is longitudinally attached may not be the lateral side. For example, the drain wire 4 may be disposed on the outer side of the shield tape 3 above or below the central portion at which the pair of insulated electric wires 2 is contacted in FIG. 4 (sectional view perpendicular to a longitudinal direction of the cable 1B). The drain wire 4 is preferably disposed at a position at which that it is well symmetric with respect to the two signal conductors 21.

In the parallel pair cable 1A of the first exemplary embodiment, the drain wire 4 is longitudinally attached to the recess of the central portion at which the pair of insulated electric wires 2 are in contact with each other so that the drain wire contacts both the insulated electric wires 2. However, when an outer diameter of the drain wire 4 is greater than the recess, the shield tape 3 and the insulated electric wires 2 may be slightly separated from each other at the periphery of the drain wire 4. In the parallel pair cable 1B of the second exemplary embodiment, since the drain wire 4 is disposed outside the shield tape 3, the drain wire 4 does not exist between the shield tape 3 and the insulated electric wires 2. For this reason, the shield tape 3 and the insulated electric wires 2 are not slightly separated from each other due to the drain wire 4, and the degree of adhesion between the shield tape 3 and the insulated electric wires 2 is improved.

That is, according to the parallel pair cable 1B configured as described above, the adhesive 31*a* is applied to the inner surface of the shield tape 3 over 30% or greater, so that the shield tape 3 can be securely adhered to the pair of insulated electric wires 2 disposed therein. Thereby, the pair of insulated electric wires 2 can be fixed by the shield tape 3 so that the relative positions thereof do not deviate.

Also, the adhesive 31*b* that is applied to the outer surface having the metal layer 3*a* provided thereon is similar to the adhesive 31*a* that is applied to the metal layer on the inner side of the shield tape described in the first exemplary embodiment. The area of the adhesion surface of the adhesive 31*b* is 30% or greater of the surface area of the metal layer 3*a*. For this reason, the shield tape 3 is adhered and fixed to the insulating tape 5 wrapped on the outer side of the shield tape 3. Thereby, the shield tape hardly shift relatively to the pair of insulated electric wires, too.

Also, since the area of the adhesion surface of the adhesive 31*b* is 70% or less of the surface area of the metal layer 3*a*, it is possible to sufficiently secure the electrical conduction between the metal layer 3*a* of the shield tape 3 and the drain wire 4.

Also, the similar effects to the first exemplary embodiment are achieved by the configurations where the shield tape 3 is longitudinally wrapped, the thickness of the insulating tape 5 is made to be large, the insulating tape 5 is spirally wrapped and the conductive adhesive is used.

By the above configurations, the shield effect for the insulated electric wires (signal wire) 2 by the shield tape 3 becomes stable, so that it is possible to reduce the output amount (Scd21) of the common mode relative to the input signal of the differential mode.

EXAMPLES

The measurement results of the mode conversion amount (Scd21) for the parallel pair cables of Examples and Comparative example are described.

In the meantime, Scd21 indicates a conversion amount from a differential mode to a common mode from Port 1 to Port 2, and is one of mixed mode S parameters. In a compliance test of a USB cable (for example, USB 3.0), Scd21 is set to −20 dB/m or less.

In the measurement, when a high-frequency signal of 20 GHz or higher was transmitted to the parallel pair cable having a length 3 m, the parallel pair cable of which a maximum value of the Scd21 value was −20 dB/m or smaller was determined as favorable, and the parallel pair cable of which the maximum value was −25 dB/m or smaller was determined as excellent. Also, the parallel pair cable of which the maximum value of the Scd21 value was greater than −20 dB/m was determined as defective.

Example 1

The parallel pair cable of Example 1 had the configuration shown in FIGS. 1 and 2, and was prepared as follows.

The parallel pair cable in which the two insulated electric wires 2, each of which had the signal conductor 21 of AWG30 and a diameter 0.96 mm, were aligned in parallel was used. The shield tape 3 having the metal layer 3*a* (thickness 8 μm) of copper and a thickness 21 μm was longitudinally wrapped around the insulated electric wires 2 so that the metal layer 3*a* was disposed on the inner side. The inner surface of the shield tape 3 (surface of the metal layer 3*a*) was applied with the insulating adhesive 31*a* (thickness 2 μm) in a zebra shape so that the area of the adhesion surface was 30% of the surface area of the metal layer 3*a*. Also, the outer surface of the shield tape 3 was thoroughly (100%) applied with the insulating adhesive 31*b* (thickness 2 μm). The drain wire 4 was longitudinally attached to the insulated electric wires 2 and was disposed inside the shield tape 3. The insulating tape 5 having a thickness 15 μm was spirally wrapped on the outer side of the shield tape 3. The insulating adhesive (thickness 2 μm) was thoroughly (100%) applied to the inner surface of the insulating tape 5.

The parallel pair cable of Example 1 was made to have a length 3 m, the high-frequency signal of 20 GHz or higher was transmitted and Scd21 was measured.

As a result, the maximum value of the Scd21 value was −25 dB/m or less, so that the quality of the parallel pair cable of Example 1 was determined as excellent. The adhesive 31*a* was applied, so that the insulated electric wires 2 and the shield tape 3 were fixed, and the shield tape 3 and the insulating tape 5 were fixed by the adhesive 31*b* and the adhesive of the insulating tape 5.

Example 2

The parallel pair cable of Example 2 had the configuration shown in FIGS. 3 and 4, and was prepared as follows.

The insulated electric wire 2 was made to have the similar configuration to Example 1. The shield tape 3 having the metal layer 3*a* of copper was longitudinally wrapped around the insulated electric wires 2 so that the metal layer 3*a* was disposed on the outer side. The inner surface of the shield tape 3 was thoroughly (100%) applied with the insulating adhesive 31*a*. Also, the outer surface of the shield tape 3 (surface of the metal layer 3*a*) was applied with the insulating adhesive 31*b* in a zebra shape so that the area of the adhesion surface was 30% of the total surface area of the metal layer 3*a*.

The drain wire 4 was longitudinally attached to the insulated electric wires 2 and was disposed outside the shield tape 3. The insulating tape 5 was made to have the similar configuration to Example 1. In the meantime, the thicknesses and diameters of the respective parts were the same as Example 1.

The parallel pair cable of Example 2 was made to have a length 3 m, the high-frequency signal of 20 GHz or higher was transmitted and Scd21 was measured.

As a result, the maximum value of the Scd21 value was −25 dB/m or less, so that the quality of the parallel pair cable of Example 2 was determined as excellent. The adhesive 31*a* was applied, so that the insulated electric wires 2 and the shield tape 3 were fixed, and the shield tape 3 and the insulating tape 5 were fixed by the adhesive 31*b* and the adhesive of the insulating tape 5.

Example 3

The parallel pair cable of Example 3 had a configuration where the adhesive 31*b* was not applied to the outer surface of the shield tape 3 similar to Example 2. The others were similar to Example 2.

The parallel pair cable of Example 3 was made to have a length 3 m, the high-frequency signal of 20 GHz or higher was transmitted and Scd21 was measured.

As a result, the maximum value of the Scd21 value was −25 dB/m or less, so that the quality of the parallel pair cable of Example 3 was determined as excellent. The adhesive 31*a* was applied, so that the insulated electric wires 2 and the shield tape 3 were fixed, and the shield tape 3 and the insulating tape 5 were fixed by the adhesive of the insulating tape 5.

Example 4

The parallel pair cable of Example 4 had a configuration where the adhesive 31*a* was not applied to the inner surface of the shield tape 3 similar to Example 1. The others were similar to Example 1.

The parallel pair cable of Example 4 was made to have a length 3 m, the high-frequency signal of 20 GHz or higher was transmitted and Scd21 was measured.

As a result, the maximum value of the Scd21 value was −20 dB/m or less, so that the quality of the parallel pair cable of Example 3 was determined as favorable. The shield tape 3 and the insulating tape 5 were fixed by the adhesive 31*b* and the adhesive of the insulating tape 5.

Example 5

The parallel pair cable of Example 5 had a configuration where the thickness of the insulating tape 5 was made greater (thickness 25 μm) in the configuration similar to Example 4.

The parallel pair cable of Example 5 was made to have a length 3 m, the high-frequency signal of 20 GHz or higher was transmitted and Scd21 was measured.

As a result, the maximum value of the Scd21 value was −25 dB/m or less, so that the quality of the parallel pair cable of Example 3 was determined as excellent. The shield tape 3 was strongly fixed by the thick insulating tape 5.

Comparative Example 1

In the configuration similar to Example 1, the adhesive was not completely applied. That is, in Comparative example 1, the inner surface and outer surface of the shield tape 3, and the inner surface of the insulating tape 5 were not completely applied with the adhesive.

The parallel pair cable of Comparative example 1 having the above configuration was made to have a length 3 m, the high-frequency signal of 20 GHz or higher was transmitted and Scd21 was measured.

As a result, the maximum value of the Scd21 value was greater than −20 dB/m, so that the quality of the parallel pair cable of Comparative example 1 was determined as defective.

Although the present invention has been described in detail with reference to the specific exemplary embodiments, it is obvious to one skilled in the art that various changes and modifications can be made without departing from the spirit and scope of the present invention. Also, the number, positions, shapes and the like of the constitutional members described above are not limited to the exemplary embodiments, and can be changed to the number, positions, shapes and the like suitable for implementation of the present invention.

What is claimed is:

1. A parallel pair cable comprising:

a pair of insulated electric wires aligned in parallel;

a shield tape longitudinally wrapped around the pair of insulated electric wires;

a drain wire disposed inside the shield tape; and an insulating tape wrapped on an outer side of the shield tape, wherein the shield tape has a metal layer provided on an inner surface thereof, wherein the drain wire is provided to electrically contact the metal layer, wherein a surface of the metal layer is provided with an adhesion surface having an adhesive applied thereto, wherein the adhesive is not applied to a surface at which the metal layer and the drain wire contact each other, wherein the adhesive is applied to a surface at which the metal layer and the drain wire do not contact each other, wherein the adhesion surface and the pair of insulated electric wires are adhered to each other, wherein an area of the adhesion surface is 30% to 70% of a surface area of the metal layer, and wherein the drain wire is longitudinally attached to a recess at which the pair of insulated electric wires aligned in parallel is in contact with each other so that the drain wire contacts both the insulated electric wires.

2. The parallel pair cable according to claim 1,
wherein the adhesive applied to the adhesion surface of the metal layer is a conductive adhesive, and
wherein the metal layer and the drain wire are adhered to each other by the conductive adhesive.

* * * * *